US011674276B2

(12) United States Patent
Allington et al.

(10) Patent No.: US 11,674,276 B2
(45) Date of Patent: Jun. 13, 2023

(54) GUARDRAIL

(71) Applicant: TROY WHEELER CONTRACTING LIMITED, Papakura (NZ)

(72) Inventors: Christopher James Allington, Leeston (NZ); Troy Douglas Wheeler, Papakura (NZ); Matthew James Bradbury, Waiuku (NZ); Jason Joseph Looij, Christchurch (NZ)

(73) Assignee: TROY WHEELER CONTRACTING LIMITED, Papakura (NZ)

( * ) Notice: Subject to any disclaimer, the term of this patent is extended or adjusted under 35 U.S.C. 154(b) by 1296 days.

(21) Appl. No.: 15/777,564

(22) PCT Filed: Nov. 17, 2016

(86) PCT No.: PCT/NZ2016/050183

§ 371 (c)(1),
(2) Date: May 18, 2018

(87) PCT Pub. No.: WO2017/086806

PCT Pub. Date: May 26, 2017

(65) Prior Publication Data

US 2021/0269996 A1 Sep. 2, 2021

(30) Foreign Application Priority Data

Nov. 18, 2015 (NZ) ..... 714289

(51) Int. Cl.
*E01F 15/04* (2006.01)

(52) U.S. Cl.
CPC ..... *E01F 15/0484* (2013.01); *E01F 15/0407* (2013.01); *E01F 15/0461* (2013.01)

(58) Field of Classification Search
CPC ..... E01F 15/0407; E01F 15/0423; E01F 15/0438; E01F 15/0461; E01F 15/04
(Continued)

(56) References Cited

U.S. PATENT DOCUMENTS 1,793,675 A * 2/1931 Camp ..... E01F 15/0423 256/13.1
2,101,176 A 12/1937 Height
(Continued)

FOREIGN PATENT DOCUMENTS

AU 2008261143 B2 7/2009
AU 2011/328558 A1 5/2013
(Continued)

OTHER PUBLICATIONS

Bolt.Com, Purlin Bolts Flanged Heads, Apr. 8, 2012, Way Back Machine (Bolt.com NPL) (Year: 2012).*
(Continued)

*Primary Examiner* — Michael P Ferguson
*Assistant Examiner* — Zachary A Hall
(74) *Attorney, Agent, or Firm* — Nixon & Vanderhye

(57) ABSTRACT

Disclosed is a guardrail including a post and a longitudinal beam, the post and longitudinal beam being linked via at least one fastener and mounting plate. The mounting plate in one embodiment includes a rigid body configured to mate with the at least one fastener; and at least one deformable region or regions about or alongside the body that, in the event of an impact on the guardrail, bends and/or breaks thereby releasing the body from the remainder of the mounting plate and in doing so allowing the post and longitudinal beam to separate. A guardrail post including at least one fastener and at least one mounting plate is also described along with a mounting plate for use in a guardrail assembly.

21 Claims, 16 Drawing Sheets

(58) Field of Classification Search
USPC ..... 256/13.1
See application file for complete search history.

(56) References Cited

U.S. PATENT DOCUMENTS

| | | | | |
|---|---|---|---|---|
| 3,314,658 | A * | 4/1967 | Norrise | E01F 15/0461 256/13.1 |
| 3,493,213 | A | 2/1970 | Ackerman | |
| 4,542,871 | A * | 9/1985 | Fortsch | F16L 3/2431 248/73 |
| 5,657,966 | A * | 8/1997 | Cicinnati | E01F 15/0438 256/13.1 |
| 6,036,399 | A * | 3/2000 | Schalk | E01F 15/0423 256/13.1 |
| 7,398,960 | B2 * | 7/2008 | Neusch | E01F 7/045 256/47 |
| 7,530,548 | B2 * | 5/2009 | Ochoa | E01F 15/0423 256/13.1 |
| 7,559,535 | B2 * | 7/2009 | King | E01F 15/0438 404/6 |
| 7,794,173 | B2 * | 9/2010 | Amengual Pericas | E01F 15/0438 404/6 |
| 7,832,713 | B2 * | 11/2010 | King | E01F 15/0438 404/6 |
| 7,878,485 | B2 | 2/2011 | Conway et al. | |
| 8,353,499 | B2 | 1/2013 | Conway et al. | |
| 8,960,647 | B2 | 2/2015 | Wallace | |
| 9,051,699 | B2 | 6/2015 | Rowland | |
| 9,200,417 | B2 | 12/2015 | Leonhardt et al. | |
| 9,217,230 | B2 * | 12/2015 | Wallace | E01F 15/0461 |
| 2006/0011900 | A1 | 1/2006 | Ochoa | |
| 2009/0194752 | A1 * | 8/2009 | Ochoa | E01F 15/0438 256/13.1 |
| 2011/0084246 | A1 | 4/2011 | Amengual Pericas | |
| 2012/0003039 | A1 | 1/2012 | Wallace et al. | |
| 2014/0145132 | A1 | 5/2014 | Leonhardt et al. | |
| 2014/0203229 | A1 * | 7/2014 | Rowland | E01F 15/043 256/13.1 |
| 2014/0209845 | A1 * | 7/2014 | Colquhoun | E04H 17/22 256/13.1 |
| 2015/0129822 | A1 * | 5/2015 | Wallace | E01F 15/0461 256/13.1 |

FOREIGN PATENT DOCUMENTS

| | | | | |
|---|---|---|---|---|
| AU | 2014202584 | | 6/2014 | |
| EP | 0924347 | | 6/1999 | |
| EP | 1061179 | A1 * | 12/2000 | E01F 15/0438 |
| EP | 1486614 | A1 * | 12/2004 | E01F 15/0453 |
| EP | 1947244 | | 7/2008 | |
| EP | 2 455 546 | A1 | 5/2012 | |
| EP | 2 628 852 | A2 | 8/2013 | |
| ES | 2238199 | A1 * | 8/2005 | E01F 15/0438 |
| FR | 1570598 | A * | 6/1969 | |
| GB | 2478864 | | 9/2011 | |
| WO | WO 1998/050637 | | 11/1998 | |
| WO | WO 2009/025997 | | 2/2009 | |
| WO | WO-2010105307 | A1 * | 9/2010 | E01F 13/12 |
| WO | 2012/062415 | A1 | 5/2012 | |
| WO | WO-2012162723 | A1 * | 12/2012 | E01F 15/0438 |
| WO | WO-2014084978 | A1 * | 6/2014 | E01F 15/0461 |

OTHER PUBLICATIONS

International Search Report, PCT/NZ2016/050183, dated Jan. 25, 2017.

Ochoa, "GMS Guardrail Mini Spacer Releasable Fastener: Improving Performance and Reliability of Conventional Strong-Post Guardrail," TRB 2008 Annual Meeting CD-ROM, 2008, 23 pages.

Gregory highway safety products division, "Gregory Mini-Spacer Guardrail System," Gregory Industries, Inc., 2007, 4 pages.

CSP Pacific, "Nu-Guard 31™ Roadside and Median Guardrail System," Installation Manual, 2008, 10 pages.

Ingal Civil Products, "Ezy-Guard™ Smart NZ Edition Product Manual," 2012, 25 pages.

* cited by examiner

GUARDRAIL

TECHNICAL FIELD

Described herein is a guardrail. More specifically, a guardrail is described of a longitudinal beam design that uses an interlocking plate and/or other parts as means to achieve desired guardrail design parameters.

BACKGROUND ART

Guardrails are used to prevent errant vehicles from impacting road hazards. Such rails are designed to contain and then redirect any vehicles that impact the guardrail without forming a hazard in its own right, for example, by pushing the vehicle into the path of oncoming traffic. To do this, the guardrail must protect the occupants of the vehicle and also not create a danger to other road users.

W-beam guardrail designs typically utilise a horizontal beam with a W-shape cross-section that is held at a suitable height via a number of vertical posts. The beam is linked to the posts. When a vehicle hits the guardrail, the vehicle forces the posts to hinge backwards. The shape of the W-beam is designed to engage with the bumper of the car. As the posts rotate backwards, the W-beam must maintain a roughly uniform height during deformation to prevent the beam falling below a critical height on the impacting vehicle where the vehicle may over-run the rail or result in an adverse vehicle motion. To do this, the W-beam must eventually separate from the posts at least near the proximity of the vehicle if the force of impact exceeds a pre-determined level. As the vehicle traverses along the barrier, the posts must separate from the rail just in front of the vehicle. Ideally, all posts upstream of the point of impact will remain attached to the rail, to assist in maintaining the height of the rail, but this is not always possible.

An example includes U.S. Pat. No. 2,101,176 that describes a hinging post that absorbs some of the impact energy. This design does not allow for disconnection of the post from the beam.

U.S. Pat. No. 3,493,213 describes placing a blockout between the beam and the posts which ensures the beam height is maintained as the posts rotate backwards. This form of blockout has benefits in providing a softer impact point between the beam and the blockout and prevents the blockout from rotating on the post. The blockout also provides a separation between the beam and the posts and thereby helps prevent snagging of the vehicles wheels on the post. The blockout does not however allow the beam to release from the posts and therefore could result in the beam being dragged down as the post is impacted.

U.S. Pat. No. 8,960,647 describes a system that allows the beam to release from the post under a controlled load via a weakened section. The load is controllable by changing the shape and size of the weakened section. Release can occur by ensuring the bolt and fastener stay attached to the face of the beam while pulling the beam away from the post. This design has the advantage that, by keeping the release mechanism attached to the beam, there should be no (or very little) debris during an impact. However, there are several disadvantages to this design. In order to work correctly, the amount of material left holding the tab in the face of the post is typically very small. This makes the posts prone to being damaged, particularly during installation. One key form of damage is that of the tabs falling out of the posts as the posts are vibrated (or driven) into the soil. Another potential issue is the ability for the guardrail system to be installed around bends. If the holding force (perpendicular to the face of the post) between the beam and the post is too great (i.e. the beam wants to pull off the front face of the post) then the tabs can pull off. This can happen when going around a small bend, as the installer will try and bend the straight beam sections through pressure in the bolt which places a load on the tab. Another issue with this design is the potential for the threaded end of the bolt and nut becoming snagging on the edges of the cut out for the tab thereby preventing the system from releasing. Furthermore, the nut for the system is installed on the inside of the post and this places a limitation on the type of post used as it must accommodate the size of the nut and have an allowance for tools to be used on the nut for tightening of the bolt.

US2012-0003039 describes a system that operates by allowing the slider to move up the posts as the posts are deformed, rotate, or hinge backwards under load. The beam is attached to the slider, which disengages from the posts from the top. For the system to work the posts have to be able to accept a slider and the bolts connecting the beam to the sliders cannot be very long (or they will hit the post on the rear side of the slider). Overall the system works well but it can be difficult to keep the sliders on the post for sufficient time to dissipate enough energy. To help with this, a series of tabs are typically installed on the post which catch onto the beam attachment bolt. These tabs slow down the motion of the slider and dissipate energy in the process. Disadvantages of this design include the fact that the sliders can move up too freely and release prematurely. The sliders also add an extra component in the system. Further, the bolts have to be short in length and installed from the front of the beam. There is very little tolerance on the placement which can make installation difficult. This is even more critical if the posts are installed at an angle to the beam which can make starting the bolt very difficult. The cost of the sliders is relatively high and tolerance issues during manufacture can be a concern. If the top of the posts get damaged during the installation process (hammering them in) then the sliders can be difficult to fit over the posts. Furthermore, if the posts twist too much during an impact (crash) then the sliders can pop off the side of the posts causing premature disengagement and a lack of energy dissipation.

U.S. Pat. No. 8,353,499 describes another sliding mechanism. In this case, the system works by allowing the bolt to slide up the slot on the front face of the post and then burst through the material at the top. The material at the top prevents the beam from prematurely popping off during an impact and allows for good energy dissipation. The slot allows for vertical adjustment of the beam relative to the post height, which makes for ease of installation. Long bolts can be used with the U-shaped posts as the thread can stick through the back. This long bolt simplifies installation. The design can be installed in back to back format (rails on both sides of the post and with blockouts included.) A problem with this design is that the material at the top of the slot has to be relatively thin or else the bolt will not be able to fracture through it. As the material region is relatively thin, it can easily be damaged during installation. Damage is most commonly seen as a vertical fracture line. If too much material is maintained at the top of the system then there is the potential for the system not to release and the posts can drag the beam down when the posts deflect backwards. The posts stand proud of the top of the beam which can cause a significant hazard to other road users, especially motorcyclists who, in an impact tend to slide along the top of the rail. The inclusion of a washer behind the head of the bolt is an annoyance for installation and can be forgotten during the installation process with significant consequences on performance. A further issue is the potential of different performance depending on the level of torque applied to the bolt; too much and they will not slide very well and too little and it will slide too easily. Another similar design is that taught in U.S. Pat. No. 7,878,485.

As should be appreciated from the above, an important aspect is to design the W-beam guardrail in such a manner that the beam is firmly attached to posts during normal (non-impacted use) and, in the event of an impact, the posts move away from the line of movement yet the beam remains at a desired height to catch and re-direct the vehicle. Much of the design work involves how the post and beam are linked and how this linkage is broken in the event of an impact. As noted above, art methods have their drawbacks often to do with difficulties around installation, but also to do with cost of manufacture and installation as well as achieving the desired outcome of vehicle capture and redirection. It would therefore be useful to address at least some of the art drawbacks or at least provide the public with a choice.

Further aspects and advantages of the guardrail will become apparent from the ensuing description that is given by way of example only.

SUMMARY

Described herein is a longitudinal beam guardrail that comprises a longitudinal beam and a post linked together indirectly via a mounting plate, the mounting plate is designed in a way that can bend and/or break in the event of an impact on the longitudinal beam thereby allowing separation of the post or posts from the longitudinal beam.

In a first aspect, there is provided a guardrail comprising a post and a longitudinal beam, the post and longitudinal beam being linked via at least one fastener and mounting plate wherein the mounting plate comprises:

- a rigid body configured to mate with the at least one fastener; and
- at least one deformable region about or alongside the body that, in the event of an impact on the guardrail, bends and/or breaks thereby releasing the body from the remainder of the mounting plate and in doing so allowing the post and longitudinal beam to separate.

In a second aspect there is provided a guardrail post, at least one fastener and at least one mounting plate wherein the mounting plate comprises:

- a rigid body configured to mate with the at least one fastener; and
- at least one deformable region about or alongside the body that, in the event of an impact on the guardrail, bends and/or breaks thereby releasing the body from the remainder of the mounting plate and in doing so allowing the post and at least one further guardrail element to separate.

In a third aspect there is provided a mounting plate for use in a guardrail assembly comprising:

- a rigid body configured to mate with at least one fastener; and
- at least one deformable region about or alongside the body that, in the event of an impact on the guardrail, bends and/or breaks thereby releasing the body from the remainder of the mounting plate and in doing so allowing the guardrail assembly or parts thereof to separate.

In a fourth aspect, there is provided a guardrail comprising a post and a longitudinal beam, the post and longitudinal beam being linked via at least one purlin bolt fastener.

As may be appreciated, the above described guardrail may provide a variety of advantages. Some examples include:

(a) The guardrail achieves the basic requirements of redirecting vehicles yet not redirecting too far or in a way that minimises the risk of causing a further hazard;

(b) The design described minimises the number of parts necessary—in some embodiments the design might only require the longitudinal beam, posts, fasteners and mounting plates. This therefore reduces expense, complexity, transport costs and makes installation simple and fast;

(c) The design provides for various independent failure modes that can be tuned or tailored to suit the design requirements needed;

(d) Failure on impact is predictable and reproducible as there are few parts and also little for the system as a whole to snag or catch on;

(e) The design ensures that the post height can be maintained below the top of the longitudinal beam thereby avoiding motorcyclists catching the top of a post in the event of an impact; and (f) If the post or posts are structurally sound post impact, the guardrail can easily be reassembled by inserting a new mounting plate.

BRIEF DESCRIPTION OF THE DRAWINGS

Further aspects of the guardrail will become apparent from the following description that is given by way of example only and with reference to the accompanying drawings in which.

DETAILED DESCRIPTION

Figure 1:
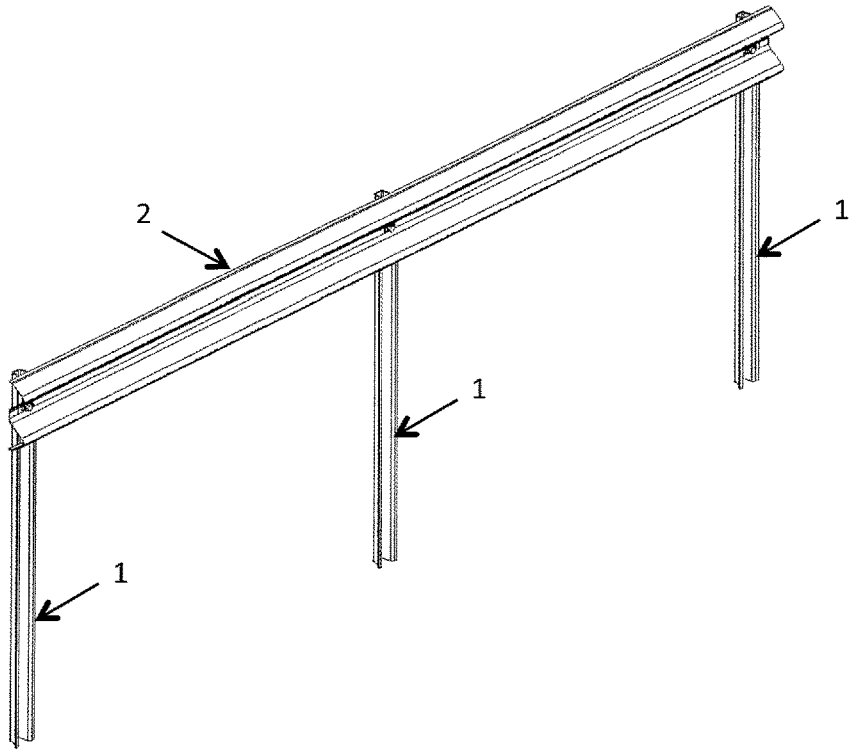
FIG. 1 illustrates a perspective view from above and front of a section of assembled guardrail section with the terminal ends of the guardrail removed for clarity.

As noted above, a longitudinal beam guardrail is described herein. The guardrail comprises a longitudinal beam and a post linked together indirectly via a mounting plate, the mounting plate designed in a way that can bend and/or break in the event of an impact on the longitudinal beam thereby allowing separation of the post or posts from the longitudinal beam.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

The term 'guardrail' and grammatical variations thereof as used herein refers to the complete assembly being the longitudinal beam or beams, a post or posts, a fastener or fasteners and a mounting plate or plates.

The term 'W-beam' as used herein refers to a W-shape cross-section beam however, unless otherwise noted, reference to a W-beam should not be seen as limiting as other shapes of longitudinal beam may also be used, examples including box beams, U-channel beams and Thrie beams.

In a first aspect, there is provided a guardrail comprising a post and a longitudinal beam, the post and longitudinal beam being linked via at least one fastener and mounting plate wherein the mounting plate comprises:

- a rigid body configured to mate with the at least one fastener; and
- at least one deformable region about or alongside the body that, in the event of an impact on the guardrail, bends and/or breaks thereby releasing the body from the remainder of the mounting plate and in doing so allowing the post and longitudinal beam to separate.

In a second aspect there is provided a guardrail post, at least one fastener and at least one mounting plate wherein the mounting plate comprises:

- a rigid body configured to mate with the at least one fastener; and
- at least one deformable region about or alongside the body that, in the event of an impact on the guardrail, bends and/or breaks thereby releasing the body from the remainder of the mounting plate and in doing so allowing the post and at least one further guardrail element to separate.

In a third aspect there is provided a mounting plate for use in a guardrail assembly comprising:

- a rigid body configured to mate with at least one fastener; and
- at least one deformable region about or alongside the body that, in the event of an impact on the guardrail, bends and/or breaks thereby releasing the body from the remainder of the mounting plate and in doing so allowing the guardrail assembly or parts thereof to separate.

The link between the post and the longitudinal beam may be indirect.

The longitudinal beam holding load may be transferred from the fastener to the post via the deformable region or regions.

The body of the mounting plate may not directly contact the post. The body of the mounting plate may be held within a post void space, the body linking directly to the fastener or fasteners and to the post via the deformable region or regions.

The term 'deformable region or regions' or grammatical variations thereof may refer to a region of the mounting plate that is weaker relative to the mounting plate body. The deformable region or regions may be characterised by having at least one of:

(a) a smaller size relative to the body;
(b) a smaller width relative to the body;
(c) a material of weaker strength or elasticity than the body;
(d) a shape of a weaker strength than the body;
(e) material treatments about the deformable region or regions; and/or
(f) a designed for failure mode (bending, shear, deformation) that influences the way the mounting plate fails and the force needed to result in failure.

As may be appreciated from the above, the exact timing of bending or breaking of the deformable region or regions may be tailored via many factors. Tailoring (or tuning) of the force needed to cause deformation may be useful for example to ensure all required standards are met in terms of a light vehicle or heavy vehicle.

The mounting plate may link the longitudinal beam to the post with linking forces transferred through the post sides. This differs considerably to most art guardrails where the front of the post is directly connected in some way with the longitudinal beam.

In the event of an impact the mounting plate may bend and/or break about the deformable region or regions and is pulled out of the post thereby releasing the post from the longitudinal beam. The timing at which deformation occurs may be varied by altering the mounting plate thickness and the size of the deformable region or regions to tailor the force needed to bend/break the mounting plate deformable region or regions.

In the event of an impact the at least one fastener may be drawn out of the mounting plate thereby releasing the post from the longitudinal beam. In this scenario, the number of threads engaged in the mounting plate may be a function of the thread pitch and mounting plate thickness, both of which can be altered to suit.

In the event of an impact the post may twist or turn sideways and the deformable region or regions of the mounting plate may bend and/or break allowing the post and longitudinal beam to separate. As noted above, the force at which bending or breaking occurs to the deformable region or regions may be tailored.

In the event of an impact the mounting plate may move upward or downward relative to the post as the post hinges backwards and when the mounting plate reaches predetermined movement limit, the deformable region or regions bend and/or break thereby releasing the post from the longitudinal beam.

As can be seen from the above examples, the forces and respective separation of the longitudinal beam and post may occur in a variety of tuneable methods. In some cases, the way that separation occurs may be a combination of the above described methods.

Deformation about the deformable region or regions may typically be caused by shear stress across the deformable region or regions.

The mounting plate may have a centrally located body and at least one arm extending on either side of the body, wherein at least part of the arm or arms comprise the deformable region or regions. In one embodiment, the mounting plate comprises two opposing arms radiating out from the body of the mounting plate although other configurations may also be used such as one, three or four arms. The deformable region or regions of an arm may be smaller than the overall arm length. The arm or a part thereof, may have at least one face that bears on at least one surface of the post when the at least one fastener is tightened. The, or each, arm may extend to a higher strength portion compared to the deformable region or regions. The higher strength region or regions may have a wider bearing face on the post. As used herein the term arm or grammatical variations thereof may also be referred to as a lug or lugs, each term may be used interchangeably.

In one embodiment, the mounting plate may comprise a single arm extending from one side of the body of the mounting plate. In this embodiment, multiple mounting plates may be used, such as two mounting plates that each have arms extending from opposing sides of the body such that together the two mounting bodies form a structure that has opposing extending arms. The two mounting bodies noted may be fastened together between the post and beam in a similar manner as described using a single mounting plate body with two arms.

In one particular embodiment, the mounting plate may comprise a body and at least one lug, the body and lug or lugs joined by at least one deformable region arm, the body and lug or lugs being stronger than the deformable region or regions. The mounting plate may comprise two lugs and two arms. The mounting plate may have an overall W-shape. By way of illustration, the mounting plate may be 50, or 60, or 70, or 80, or 90, or 100, or 110, or 120, or 130, or 140, or 150, or 160, or 170, or 180, or 190, or 200 mm wide. In one embodiment, the mounting plate may be from 50 to 200 mm wide. Further, the mounting plate may be 30, or 40, or 50, or 60, or 70, or 80, or 90, or 100 mm high. In one embodiment, the mounting plate may be 30-100 mm high. Further, the mounting plate may be 3, or 4, or 5, or 6, or 7, or 8, or 9, or 10 mm thick. In one embodiment, the mounting plate may be 3 to 10 mm thick. In one specific embodiment, the mounting plate may be approximately 100 mm wide, 46 mm high, and 5 mm thick. This specific embodiment size is given purely by way of illustration only and it should be appreciated that the size and material grade may be altered due to a number of factors including post size and shape, force tolerances, cost considerations and may other factors.

The mounting plate may be made from one or more materials having medium strength properties that may provide sufficient structural strength while also enabling the required deformability requirements. For example, a material having a nominal yield strength of at least 250 megapascal (MPa) may be used. In one embodiment, the mounting plate may be made from grade 250 steel. In some embodiments the mounting plate may be formed from a plurality of materials. For example, one or more components of the mounting plate, namely the body, arms or deformable arm regions, may be formed of a different material to one or more of the other components of the mounting body.

The lug or lugs noted above may help to seat the mounting plate and limit the range of movement of the mounting plate once fitted into the post slot or slots. Limiting rotational movement may be useful to avoid the plate spinning when the fastener is tightened thereby ensuring the fastener draws into the plate. The range of movement limited by the lug or lugs may be rotational and/or vertical plane movement of the mounting plate relative to the post.

The mounting plate deformable region or regions (or arms or lugs as noted above) may be sized so that, once a maximum desired rotational and/or vertical movement tolerance is reached, the region or regions abut an edge of a slot in the post and further rotational and/or vertical movement may be prevented.

The post may be U-shaped and comprise at least one elongated slot on or about the post side or sides and the mounting plate deformable region or regions extend horizontally through the slot or slots. The U-shape post may include at least one flange extending from each end of the U-shape cross-section that the deformable region or regions may bear on. U shaped posts are known. They are useful structurally as, for a given material thickness, they have greater strength than a straight post. U-shaped posts also nest together hence can be stacked to a compact size during storage and transportation. U-shaped posts are also relatively easy to shape. Further, due to the greater strength, this style of post may be easier to drive into the ground and therefore avoid post damage during installation. By way of example, the post elongated slots may be 80-100 mm long and 5-10 mm wide. The slot or slots may start from around 50 mm below the top of the post. The slot or slots may be located at any point along the post sides. These dimensions are provided by way of example only and should not be seen as limiting.

The at least one slot in the post may be sized to have some degree of tolerance so that the mounting plate, when disposed in the post slot or slots, may be able to move relative to the post and fastener. The slot or slots may be sufficiently elongated to allow up to 45 degrees of rotational movement of the mounting plate relative to the post about a horizontal axis. The slot or slots may be sufficiently wide to allow up to 30 degrees of rotational movement of the mounting plate relative to the post about a vertical axis. The slot or slots are sufficiently elongated to allow for up to 100 mm of vertical movement in the mounting plate up or down relative to the post. Allowing some tolerance for the mounting plate to move within the slots may be an advantage as, for example, this allows for wrongly aligned posts—the plate can be re-orientated in the post which makes it easier to align the bolt and longitudinal beam.

The slot or slots in the post may have a relief feature such as an indent cut so that when the post steel is bent, localised stresses about the bend do not cause cracks or weaknesses to develop about the slot's upper or lower faces.

The at least one fastener may be releasable. The at least one fastener passes through at least a portion of the longitudinal beam to link with the mounting plate body. In one embodiment, the at least one fastener passes through at least the central portion of the longitudinal beam to link with the mounting plate body. The at least one fastener may be a bolt with a male thread that threads directly into a complementary female thread on the mounting plate. The at least one fastener may be a bolt with a male thread that threads onto a nut and the mounting plate acts as a washer, the shaft of the bolt passing through a hole in the mounting plate before meeting the nut. In one embodiment, the at least one fastener may be a purlin bolt. In the inventor's experience, purlin bolts are not used in guardrails yet offer a large advantage in that they have a large bearing surface under the head hence are strong under tension loading.

The at least one fastener head may be located on the outwards facing side of the longitudinal beam and has a smooth shape. Outwards refers to the side of the longitudinal beam that a vehicle might impact against. A smooth shape may be preferable as this avoids objects and vehicles snagging or catching on the bolts. Ideally the vehicle slides along the longitudinal beam during an impact in order to help redirect and guide the vehicle to safety.

In a fourth aspect, there is provided a guardrail comprising a post and a longitudinal beam, the post and longitudinal beam being linked via at least one purlin bolt fastener.

The purlin bolt above may indirectly link the longitudinal beam and post together. The indirect linkage may be via a mounting plate, the mounting plate transferring the force of the bolt on the longitudinal beam to the post or posts.

The purlin bolt may have a bolt head at least twice the shaft width to increase the bearing face on the longitudinal beam.

The purlin bolt head may have a generally smooth shape.

The purlin bolt head has a generally smooth shape tapering to a hex head, the hex head having a smaller diameter relative to the bolt shank.

The bolt as used above may be an M16 bolt although it should be appreciated that a range of other bolt sizes may be used and the same or similar outcomes achieved.

The post may have generally upright/vertical position once driven into the ground. Posts in the assembled form may be spaced at varying distances such as 1, or 1.5, or 2, or 2.5, or 3 metre intervals, or as necessary to locate with the mounting location on the beam.

The overall guardrail length may be varied to suit the end application. The guardrail as a whole may have terminating ends. The terminating ends may be of varying design to the wider guardrail configuration.

The longitudinal beam may follow a generally horizontal alignment typically following the road contours and having a constant height above the road commensurate with where a vehicle bumper might impact the longitudinal beam.

The top of each post terminates about or below the top of the longitudinal beam. This avoids any danger from the posts hitting an impacting object—for example a motorcyclist sliding along the longitudinal beam.

To assemble the guardrail, the mounting plate may be inserted into the post slots, optionally by pushing the arm/lug through one side and then inserting the other arm/lug through the other side, and the plate by gravity tends to want to seat at the base of the slot but is free to move upwards in the slot to be positioned as may be desired. The mounting plate can also move rotationally up to a point in the slots either about a vertical or horizontal axis. A fastener is inserted through the longitudinal beam (typically about the mid-section) and the fastener is threaded into a complementary female threaded hole into the body of the mounting plate until the parts are all firmly together. As should be appreciated, installation is relatively simple—drive the post separately, drop in the plate and attach the rail. This simple method avoids damage on installation to the connection point as the mounting plate is fitted after post driving. No or minimal tension exists on the parts prior to tightening of the bolt when assembling and long bolts can be used to help with linking the parts—this can be particularly useful on bends or radii where the longitudinal beam may tend to want to move away from the post location. Further, damage to the top of a post, as may often occur during installation, does not impact on the performance of the guardrail design described herein. Art guardrails often can become compromised when damage occurs to the top of the post.

As may be appreciated, the above described guardrail may provide a variety of advantages. Some examples include:

(a) The guardrail achieves the basic requirements of redirecting vehicles yet not redirecting too far or in a way that minimises the risk of causing a further hazard;

(b) The design described minimises the number of parts necessary—in some embodiments the design might only require the longitudinal beam, posts, fasteners and mounting plates. This therefore reduces expense, complexity, transport costs and makes installation simple and fast;

(c) The design provides for various independent failure modes that can be tuned or tailored to suit the design requirements needed;

(d) Failure on impact is predictable and reproducible as there are few parts and also little for the system as a whole to snag or catch on;

(e) The design ensures that the post height can be maintained below the top of the longitudinal beam thereby avoiding motorcyclists catching the top of a post in the event of an impact; and (f) If the post or posts are structurally sound post impact, the guardrail can easily be reassembled by inserting a new mounting plate.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as of individually set forth.

WORKING EXAMPLES

The above described guardrail is now described by reference to specific examples.

Example 1

Referring to FIGS. 1 to 9B, as shown, the guardrail comprises a post 1 and a W-beam 2, the post 1 and W-beam 2 being linked via a fastener 3 and a mounting plate 4. The mounting plate 4 comprises a rigid body 5 that mates with the at least one fastener 3 and two arms or lugs 6 with deformable regions 7 between the arm or lug 6 ending and the body 5. The end of the arm or lug 6 region bears on the post 1 when the fastener 3 is tightened. The W-beam 2 holding load is therefore transferred from the fastener 3 to the post 1 via the deformable region or regions 7 and the body 5 does not touch the post 1 itself—there is an indirect loading of the W-beam 2 to the post 1. In the example shown, the deformable region 7 is characterised by having a smaller size and shape relative to the body 5 and arms or lugs 6. This therefore creates a weak point between the body 5 and lugs 6 that is more susceptible to a shear force than the other parts. Once this region shears, the body 5 is then able to move independently of the end lugs and hence the W-beam 2 and post 1 can also move separately. Other methods to create a weaker region can also be used as described above.

A unique aspect of the design shown in FIGS. 1-9B is that the linking forces are transferred through the post 1 sides. This differs considerably to most art guardrails where the front of the post 1 is directly connected in some way with the W-beam 2.

Figure 5:
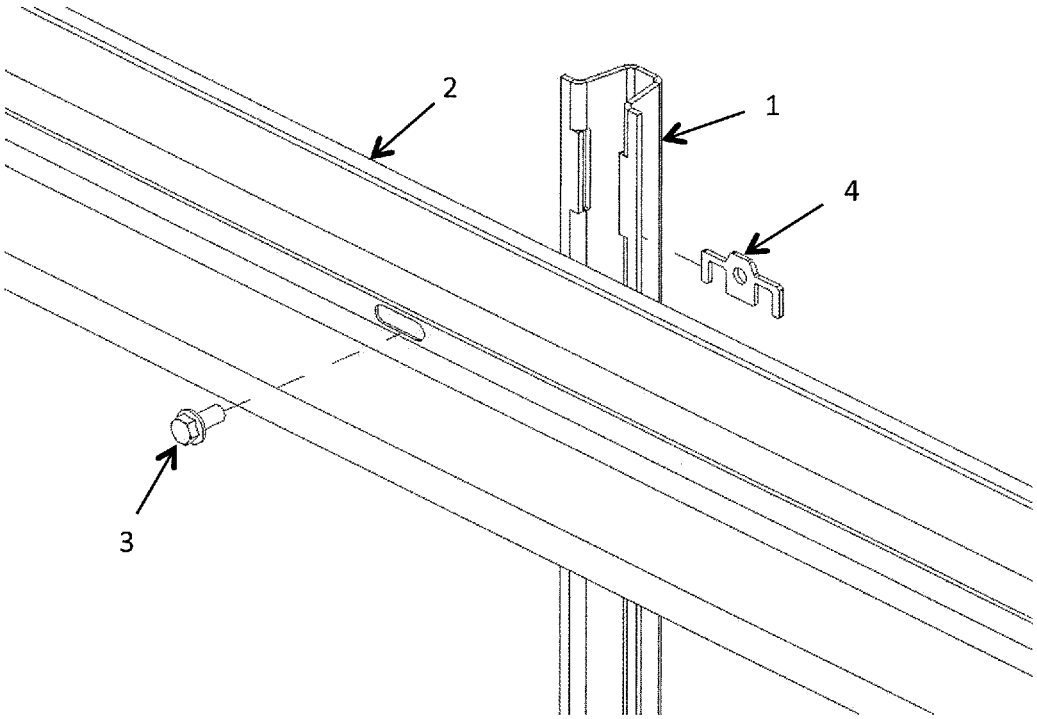
FIG. 5 illustrates an exploded perspective view from the front of the guard rail.
Figure 6:
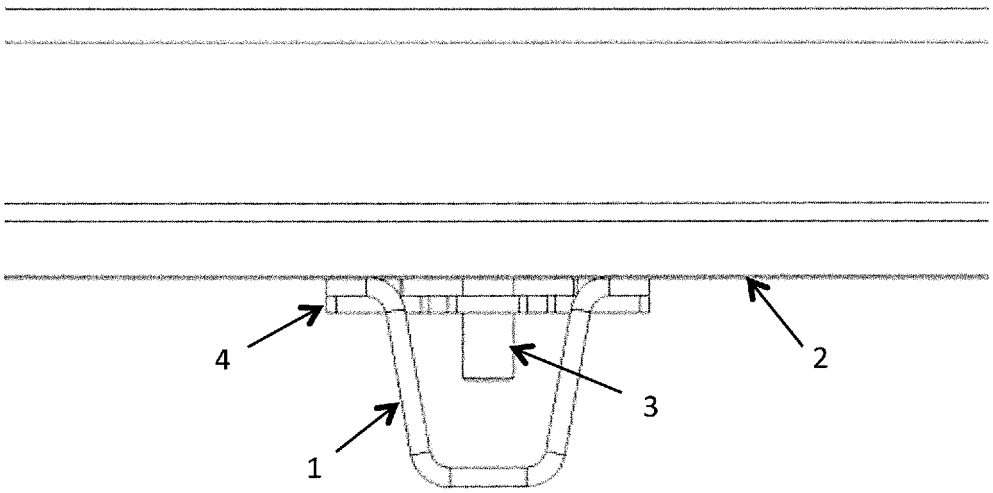
FIG. 6 illustrates a detail plan view of the assembled guard rail.
Figure 7A:
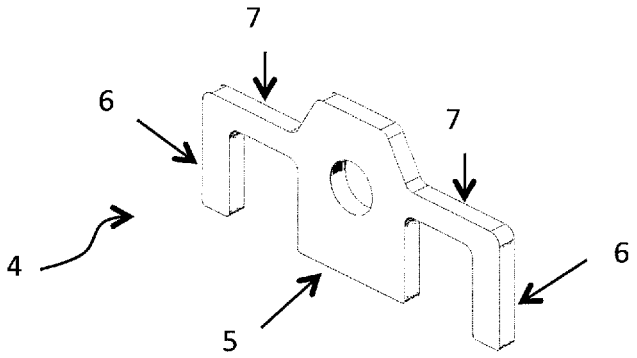
FIGS. 7A, 7B and 7C illustrate perspective, front elevation and side elevation views of one embodiment of a mounting plate.
Figure 7B:
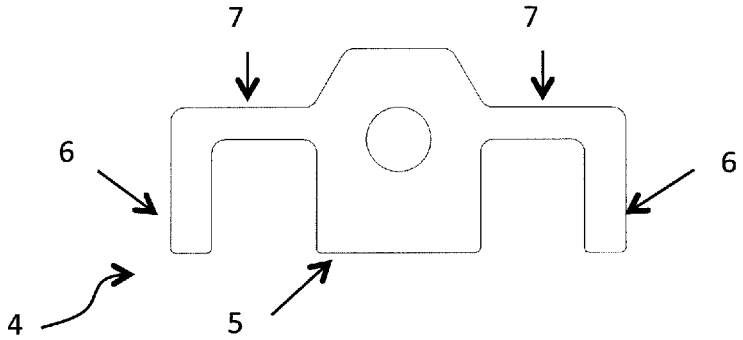
Figure 7C:
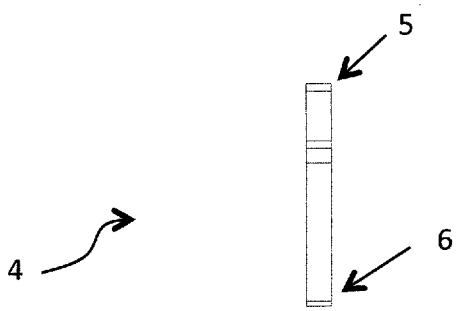
Figure 8A:
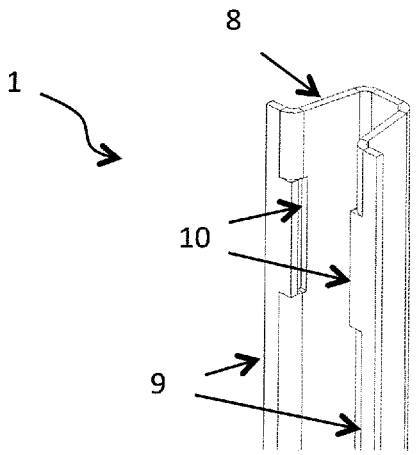
FIGS. 8A and 8B illustrate perspective and side elevation views of one embodiment of a post.
Figure 8B:
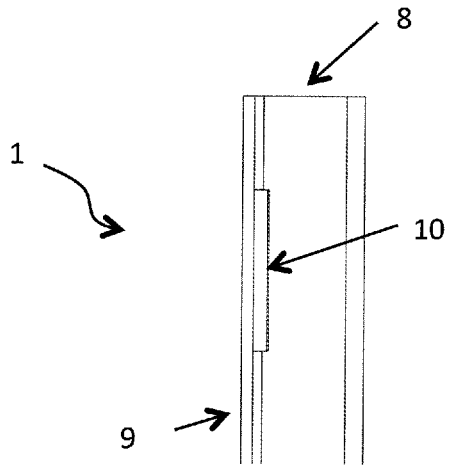
Figure 9A:
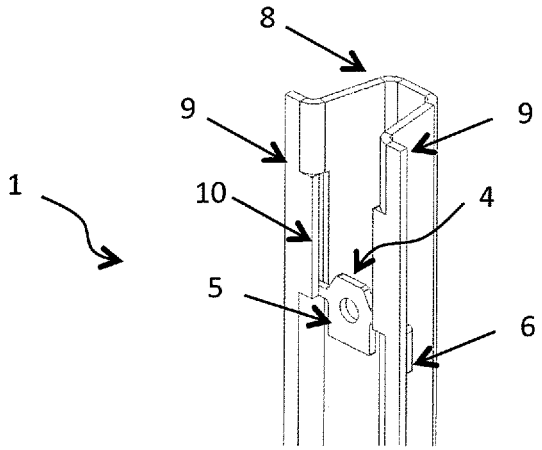
FIGS. 9A and 9B illustrate perspective views of the front and rear of a post showing one position of the mounting plate relative to the post.
Figure 9B:
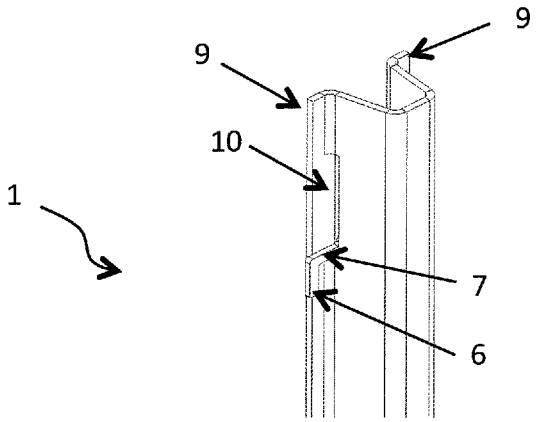

In more detail, the mounting plate 4 shown in FIGS. 1-9B and especially FIGS. 7A, 7B and 7C may be 100 mm wide, 46 mm high, 5 mm thick and all made from grade 250 steel. This size is given purely by way of illustration only and it should be appreciated that the size and material grade may be altered due to a number of factors including post 1 size and shape, force tolerances, cost considerations and many other factors.

Figure 2:
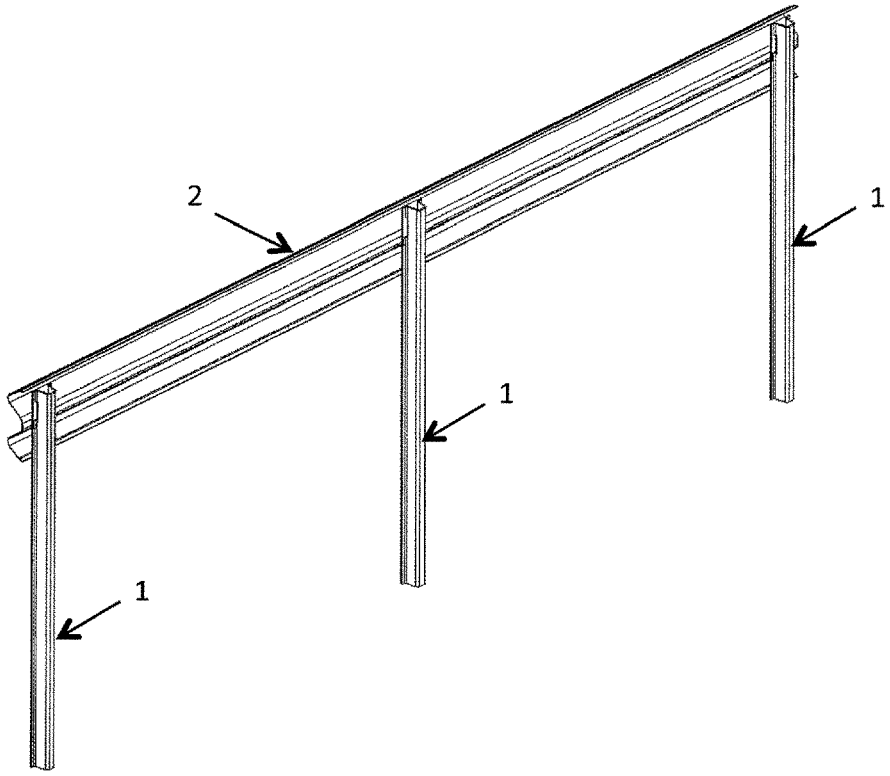
FIG. 2 illustrates a perspective view from above and rear of a section of assembled guardrail section with the terminal ends of the guardrail removed for clarity.

The posts 1 as shown in FIGS. 1 and 2 when installed have a generally upright/vertical position once driven into the ground and are spaced at 1 to 3 metre intervals, in FIGS. 1 and 2 shown at 2 metre intervals. The post 1 shown in more detail in FIGS. 3 to 6, 8A and 8B and 9A and 9B has a U-shape cross-section 8 with flanges 9 extending from each end of the U-shape 8. Elongated slots 10 best seen in FIGS. 4, 5, 8A, 8B and 9A and 9B are inserted into the sides of the post 1 and the mounting plate 4 is disposed into the slots 10. By way of example, the post elongated slots 10 may be 80-100 mm long and 5-10 mm wide. The post slot or slots 10 may start from around 50 mm below the top of the post 1. These dimensions are provided by way of example only and should not be seen as limiting. A person skilled in the art would appreciate that the size of the post slot 10 must be sufficient to allow insertion of an arm or lug 6 of the mounting plate and to allow a sufficient degree of freedom of movement for the mounting plate 4 and post 1 relative to each other to facilitate assembly of the guardrail as discussed below.

The lug or lugs 6 noted above help to seat the mounting plate 4 and limit the range of movement of the mounting plate 4 once fitted into the post 1 slot or slots 10. Movement may be rotational, for example in response to torque force on the fastener 3 urging rotation about a horizontal axis or a sideways turning force on the fastener 3 urging rotation about a vertical axis. Movement may be in a vertical up and down direction as well with the plate travelling through the post elongated slots 10. The degree of movement of the mounting plate 4 may be limited by the size of the elongated slots 10 in the post 1. Some degree of movement of the plate in the post slots 10 has been found to be a significant advantage during installation. This tolerance allows for imperfect post 1 positioning and also simplifies the process of mating a fastener 3 between the W-beam 2 and mounting plate 4 since the mounting plate 4 can be moved to suit the angle of the fastener 3.

Figure 3:
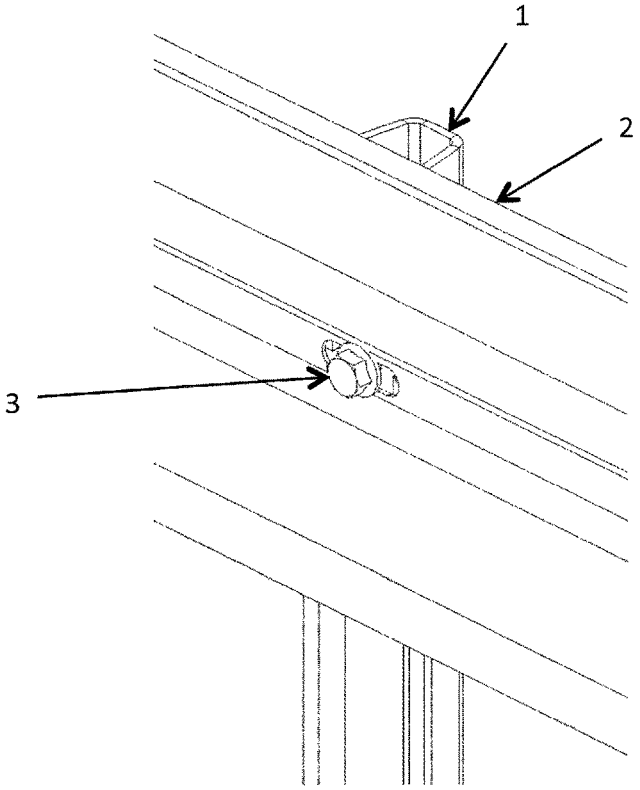
FIG. 3 illustrates a detail perspective view of the front of an assembled guardrail about one post.
Figure 4:
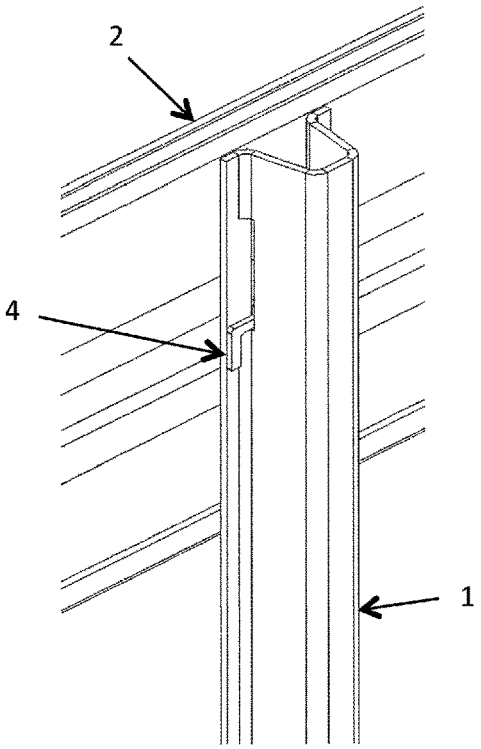
FIG. 4 illustrates a detail perspective view of the rear of an assembled guardrail about one post.

As shown in FIGS. 1-9B, particularly FIGS. 3, 5 and 6, the fastener 3 passes through the central portion of the W-beam 2 to link with the mounting plate 4 body 5. The fastener 3 shown in FIGS. 1-9 and particularly FIGS. 3, 5 and 6 is a bolt with a male thread that threads directly into a complementary female thread on the mounting plate 4. Alternatively, the mounting plate 4 can be a hole and the bolt fits through the hole and threads into a nut.

The fastener 3 head is located on the outwards (front) facing side of the W-beam 2 and has a smooth shape. A smooth shape may be preferable as this avoids objects and vehicles snagging or catching on the bolts.

The bolt used may be a purlin bolt. A purlin bolt may be useful since the bolt head has a greater bearing face on the W-beam 2 hence more strength. The purlin bolt head may have a generally smooth shape tapering to a hex head, the hex head having a smaller diameter relative to the bolt shank. This hex head may help to tighten the bolt.

The bolt shown in FIGS. 1-9B may be a M16 bolt although a range of other bolt sizes may be used as desired to meet the end design requirements.

The overall guardrail length may be varied to suit the end application. The guardrail as a whole has terminating ends that can have a varying design to the wider guardrail configuration. Detail on the terminating ends has been removed from the Figures for clarity.

As best seen in FIGS. 1 and 2, the W-beam 2 may follow a generally horizontal alignment typically following the road contours and has a constant height above the road commensurate with where a vehicle bumper might impact the W-beam 2.

As shown at least in FIGS. 1 and 2, the top of each post 1 terminates about or below the top of the W-beam 2. This avoids any danger from the posts 1 hitting an impacting object—for example a motorcyclist sliding along the W-beam 2.

To assemble the guardrail, the mounting plate 4 is inserted arms or lugs 6 down into the post slots 10 by inserting one arm/lug 6 through one post slot 10 and then inserting the other arm/lug 6 through the other post slot 10. The mounting plate 4, by gravity, then tends to want to seat at the base of the slot 10 but is free to move upwards in the slot 10 to be positioned as may be desired. The mounting plate 4 can also move rotationally up to a point in the slots 10 either about a vertical or horizontal axis or vertically up and down also limited by the slot 10 length. A fastener 3 is inserted through the W-beam 2 (typically about the mid-section) and the fastener 3 is threaded into a complementary female threaded hole in the body 5 of the mounting plate 4 until the parts are all firmly tied together. As the fastener 3 is tightened, the bearing faces of the arms/lugs 6 pull the post 1 and W-beam 2 together.

As should be appreciated, installation is relatively simple—drive the post 1 separately, drop in the plate and attach the rail. This simple method avoids damage on installation to the connection point as the mounting plate 4 is fitted after post 1 driving. No or minimal tension exists on the parts prior to tightening of the bolt when assembling and long bolts can be used to help with linking the parts—this can be particularly useful on bends where the W-beam 2 may tend to want to move away from the post 1 location. Further, damage to the top of a post 1, as may often occur during installation, does not impact on the performance of the guardrail design described herein. Art guardrails often can become compromised when damage occurs to the top of the post 1.

Example 2

In this example, part interaction in the event of a vehicle impact is shown with reference to FIGS. 10A to 10H.

The exact timing of bending or breaking of the deformable region or regions and the way this occurs can be tailored via many factors as noted above. Tailoring (or tuning) of the force needed to cause deformation is in the inventor's experience useful to ensure that all required performance is achieved when impacted with a light vehicle as well as a heavy vehicle.

Figure 10A:
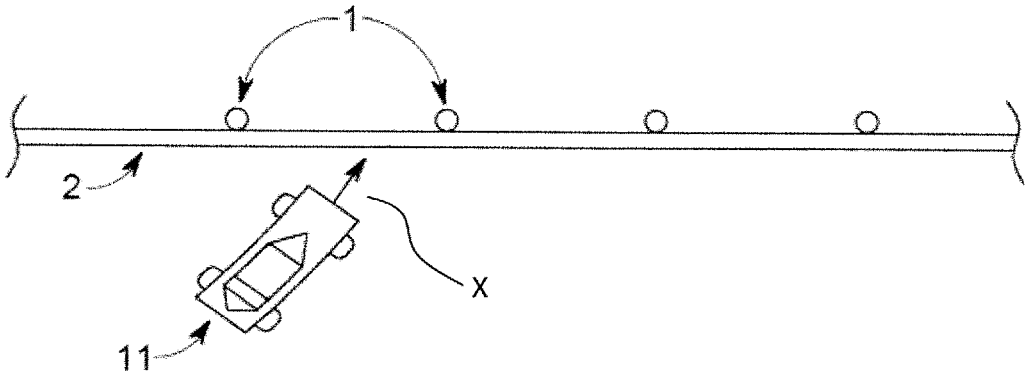
FIGS. 10A to 10H illustrate stylised sketches from above, the side and perspective views of the guardrail and movement of the parts according to a first impact scenario.
Figure 10B:
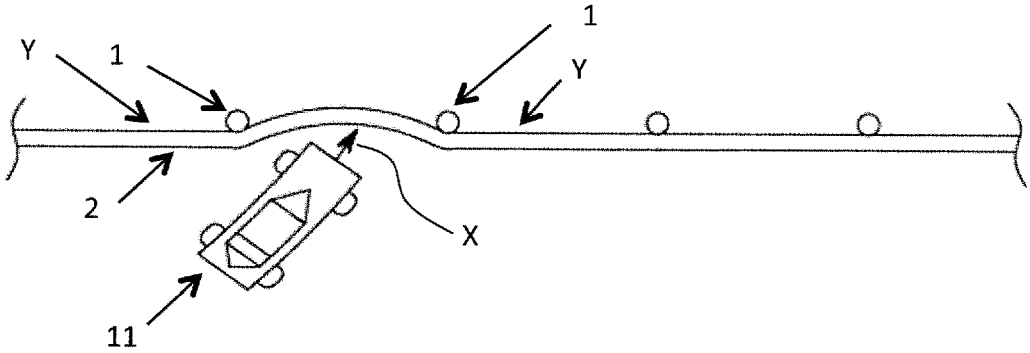

Scenario 1—Mounting Plate Deformable Regions Failure Due to Outward Tension Force on Fastener Referring to FIGS. 10A and 10B, in a first separation scenario, a vehicle 11 impacts the W-beam 2, causing it to deform inwards at the point of impact (indicated by arrow X). Forward Y and aft Y of the impact zone X, the W-beam 2 buckles outwards in reaction to the impact force X, resulting in a high outwards tension force on fastener 3. As a result of this force, the mounting plate 4 bends and/or breaks about the deformable region or regions 7 and is pulled out of the post 1 thereby releasing the post 1 from the W-beam 2.

Figure 10C:
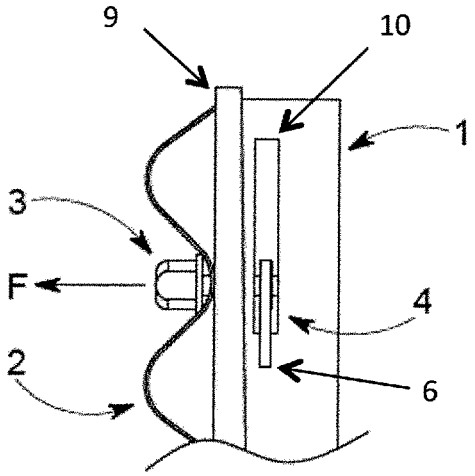
Figure 10D:
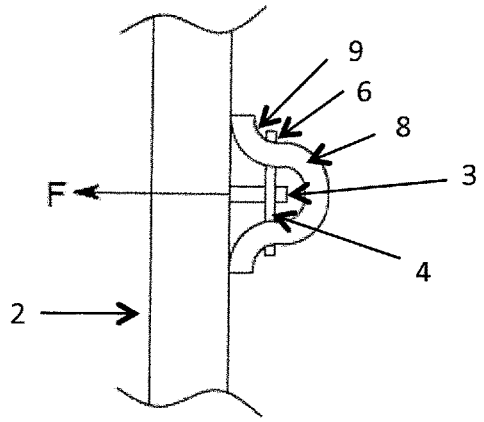

FIGS. 10C and 10D show side (10C) and plan (10D) elevations of the guardrail prior to impact. The assembled guardrail comprises a W-beam 2 coupled indirectly to a post 1, the post 1 being a U-shape cross-section beam 8 with flanges 9 abutting the W-beam 2. Indirect coupling is achieved via the mounting plate 4 that links via the mounting plate 4 lugs 6 to the post 1, the lugs 6 extending through elongated slots 10 in the post 1 sides. The body 5 of the mounting plate 4 is linked to a fastener 3, the fastener 3 coupling the mounting plate 4 to the W-beam 2. In the assembled position prior to impact, the mounting plate 4 lugs 6 are located towards the base of the elongated slots 10. A tension force F caused by the fastener 3 holds the post 1 and W-beam 2 together.

Figure 10E:
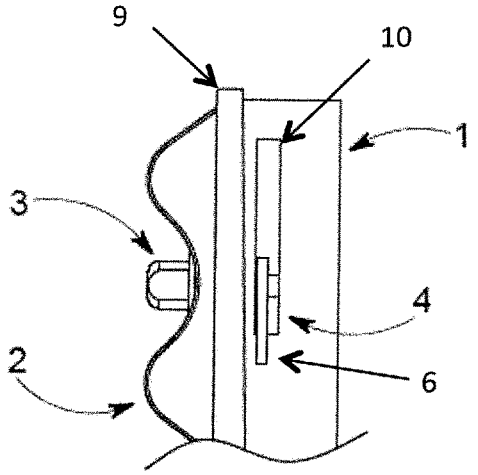
Figure 10F:
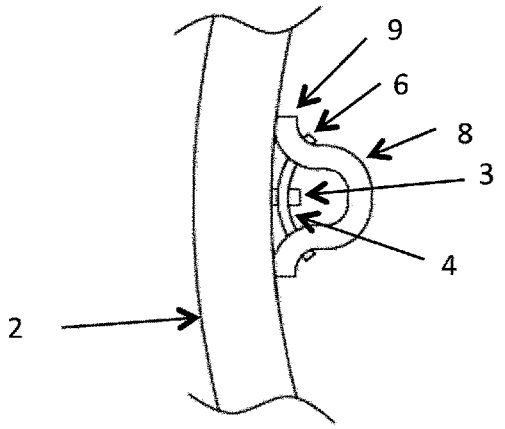

FIGS. 10E and 10F show side (10E) and plan (10F) elevations of the deformation that would be expected during impact (prior to mounting plate 4 separation) with the W-beam 2 squashing against the post 1 and some flexing of the W-beam elongated shape best seen in the FIG. 10F.

Figure 10G:
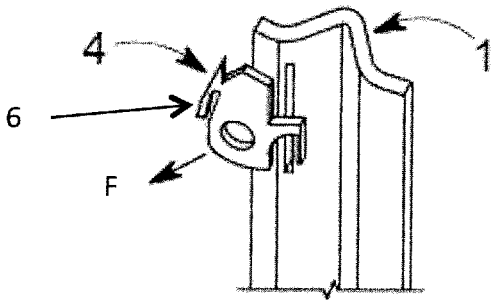
Figure 10H:
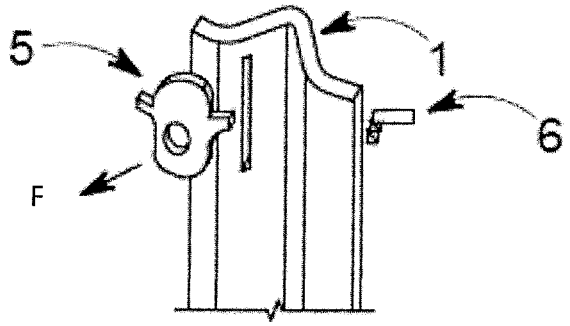

FIGS. 10G and 10H show perspective views of the scenario where the mounting plate 4 separates from post 1 due to deformation about the deformable regions 7. FIG. 10G illustrates the scenario where mounting plate 4 separates from the post 1 due to bending or otherwise deformation occurring resulting in the mounting plate 4 separating or being pulled from the elongated slots 10. FIG. 10H illustrates the scenario where mounting plate 4 separates from the post 1 due to shear failure of the deformable regions 7 with the body 5 and lugs 6 parting and the body then free to move from the post 8. Either separation method may occur depending on the specific forces imposed by the impact on the guardrail.

The tension force required for failure of the mounting plate 4 deformable regions 7 can be tuned by altering the thickness of the mounting plate 4 and the dimensions of the deformable regions 7 and the arms 6.

Figure 11A:
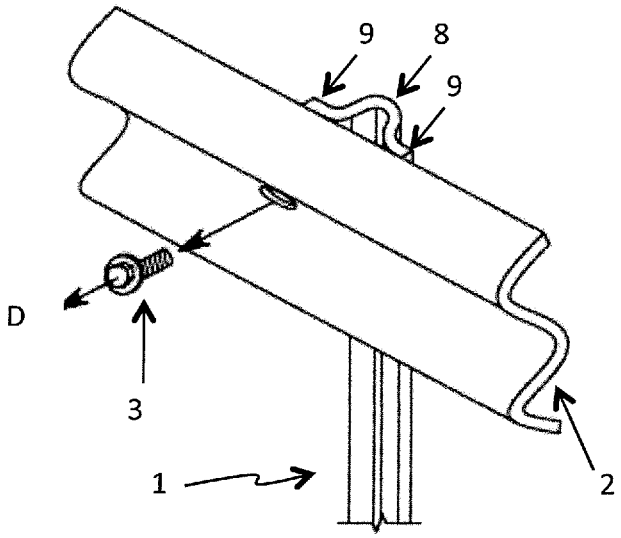
FIGS. 11A and 11B illustrate stylised sketches in perspective and from above of the guardrail and movement of the parts according to a second impact scenario.
Figure 11B:
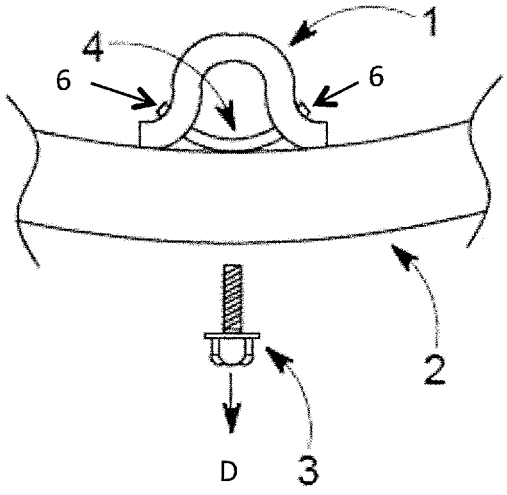

Scenario 2—Mounting Plate Fastener Hole Failure Due to Outward Tension Force on Fastener An alternative separation scenario can occur under the same impact conditions discussed in Scenario 1 and illustrated in FIGS. 11A and 11B. In this second separation scenario, the fastener 3 is pulled out of the mounting plate 4 in direction D, stripping the threads from the mounting plate 4 and/or fastener 3 and thereby releasing the post 1 from the W-beam 2.

In this scenario, the number of threads engaged in the mounting plate 4 may be a function of the thread pitch and plate thickness, both of which can be altered to tune the tension force required for failure.

Figure 12A:
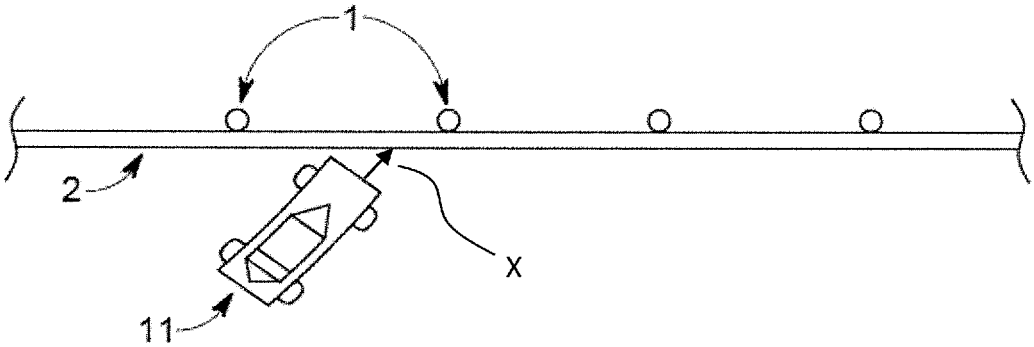
FIGS. 12A, 12B and 12C illustrate stylised sketches from above, and side of the guardrail and movement of the parts according to a third impact scenario.
Figure 12B:
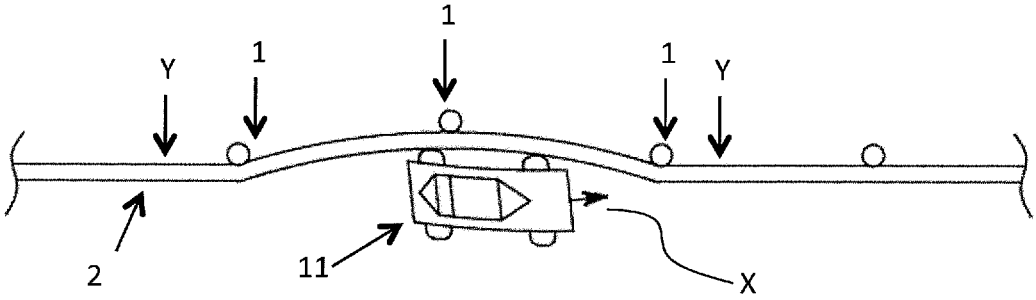
Figure 12C:
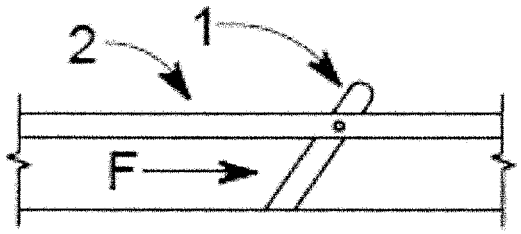

Scenario 3—Mounting Plate Deformable Regions Failure Due to Sideways Movement of Post Referring to FIGS. 12A, 12B and 12C, in a third separation scenario, a vehicle 11 approaches in direction X (FIG. 12A) and then impacts (FIG. 12B) the W-beam 2. The impact force and the vehicle 11 direction of motion (marked by arrow X) is redirected to be approximately parallel to the W-beam 2. As shown in FIG. 12C, the vehicle 11 (not shown in FIG. 12C for clarity) contacts a post 1, causing the post 1 to twist or turn sideways. Sideways movement of a post 1 or posts 1 imparts a force on at least one of the arms or lugs 6 of the mounting plate 4 (not shown in FIG. 12C). This imparted force in turn causes the mounting plate 4 to bend and/or break about the deformable region or regions 7, thereby allowing the post 1 and W-beam 2 to separate.

Figure 13A:
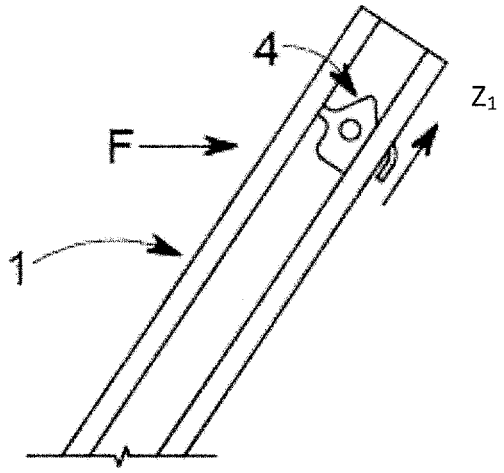
FIGS. 13A, 13B and 13C illustrate stylised sketches from the side of the guardrail further illustrating movement of the mounting plate relative to the post according to the third impact scenario.
Figure 13B:
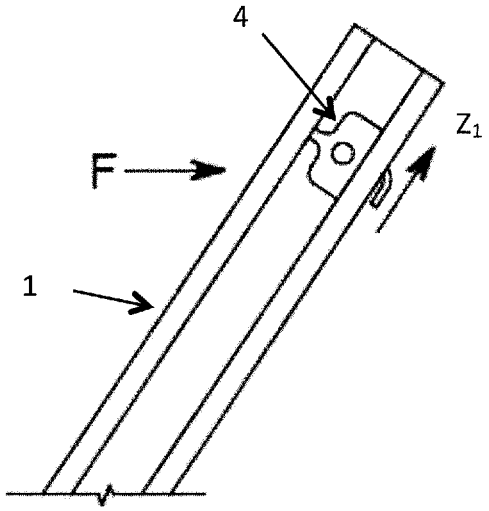
Figure 13C:
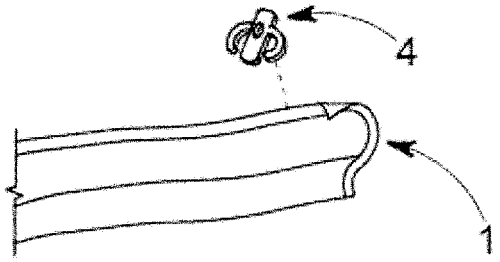

FIGS. 13A, 13B and 13C show the process of separation in more detail with the W-beam removed for clarity to show movement of the mounting plate 4. FIGS. 13A and 13B show the post 1 bending post impact in direction F and, as this happens, the mounting plate 4 including the lugs 6 moves upward relative to the elongated slots in direction $Z_1$. Eventually the combination of upwards movement $Z_1$ and twisting of the post 1 becomes sufficient to cause the mounting plate 4 to release from the post 1 elongated slots either through deformation (as shown in FIG. 13C) or shearing (not shown) of the lug or lugs 6.

As noted above, the dimensions of the mounting plate deformable regions 7 and arms 6 may be altered to tune the force required for separation.

Figure 14A:
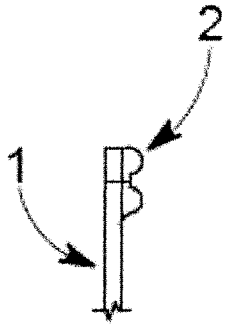
FIGS. 14A, 14B, 14C and 14D illustrate stylised sketches of the guardrail from the side and in perspective showing movement of the parts according to a fourth impact scenario.
Figure 14B:
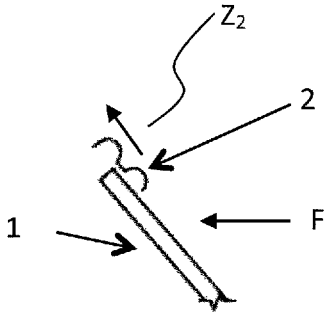
Figure 14C:
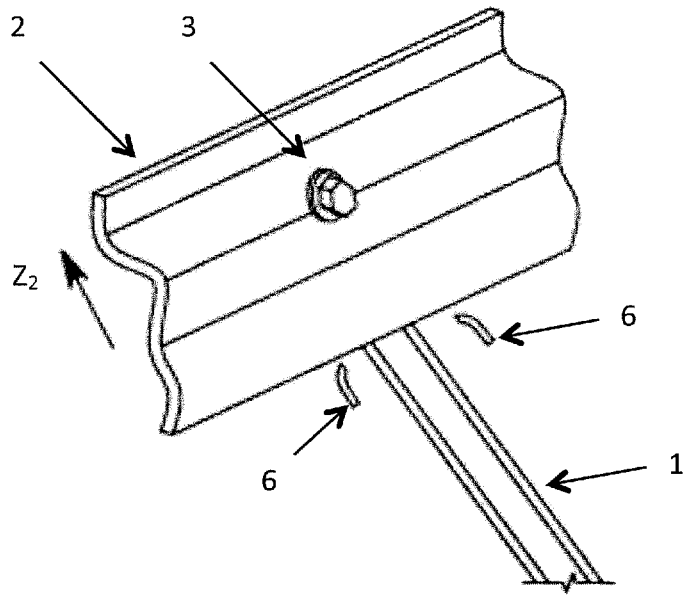
Figure 14D:
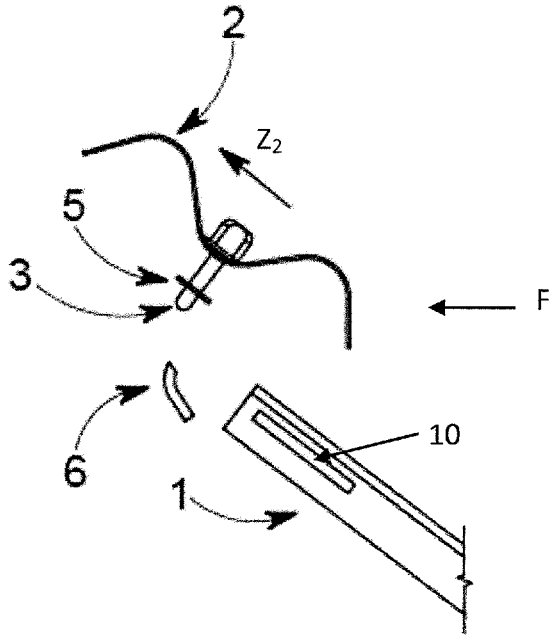

Scenario 4—Mounting Plate Deformable Regions Failure Due to Inwards Bending of Post Referring to FIGS. 14A, 14B, 14C and 14D, in a fourth separation scenario, a vehicle (not shown) impact causes a post 1 to bend inwards about the base of the post 1 drawn schematically in FIG. 14A (upright not impacted) and FIG. 14B impacted and bending. The mounting plate 4 (marked in other Figures e.g. FIG. 7A to 7C) comprising a body 5 and lugs 6 and W-beam 2 in this example may move up in direction $Z_2$ relative to the post 1 along the elongated slots 10 as the post 1 hinges backwards to enable the W-beam 2 to stay at the same height. As shown in FIGS. 14C and 14D, when an arm or arms 6 of the mounting plate body 5 reach the top of one or both elongated post slots 10, the deformable region or regions 7 (shown in other Figures) bend and/or break thereby releasing the lug or lugs 6 from the body 5 of the mounting plate 4 and consequently releasing the W-beam 2 from the post 1 best seen in FIGS. 14C and 14D. The impact direction force is indicated by arrow F in FIGS. 14B and 14D.

As above, the dimensions of the mounting plate 4 deformable regions 7 and arms 6 may be altered to tune the force required for separation.

As can be seen from the above scenarios, the forces and respective separation of the W-beam 2 and post 1 may occur in a variety of tuneable methods. As should be appreciated, the way that separation occurs can be a combination of the above described methods. Further, the timing at which deformation occurs may be varied by altering the plate thickness and the size of the deformable region or regions 7 to tailor the force needed to bend/break the plate deformable region or regions 7.

Example 3

In this example, a variety of alternative mounting plate 4 and post 1 shapes are shown.

Figure 15:
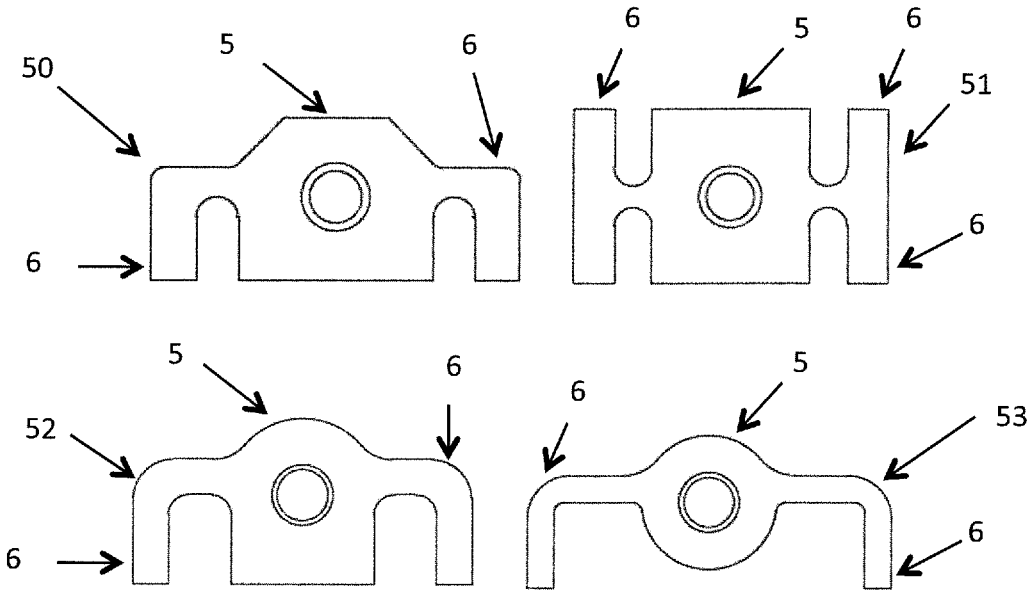
FIG. 15 illustrates various alternative mounting plate shapes that may be used.

Referring to FIG. 15, a number of different shaped plates are illustrated. The mounting plate 4 shown in the earlier FIGS. 1 to 14D represents one means of achieving the desired design parameters. The various embodiments shown in FIG. 15 illustrate how the shape can be varied by altering the body 5 shape, the arm 6 shape, the number of arms 6 and the size and orientation of the end of the arms 6. Specifically, the mounting plate may have the shape indicated by arrow 50 with a reduced body 5 size. Alternatively, the shape may be like that indicated in arrow 51 with additional lugs 6 (four in total shown in item 51). The shape may further be like that shown by item 52 with narrowed lugs 6 and a rounded shape. Finally, the shape may like that shown by item 53 with a shrunk body 5 and elongated lugs 6.

Figure 16:
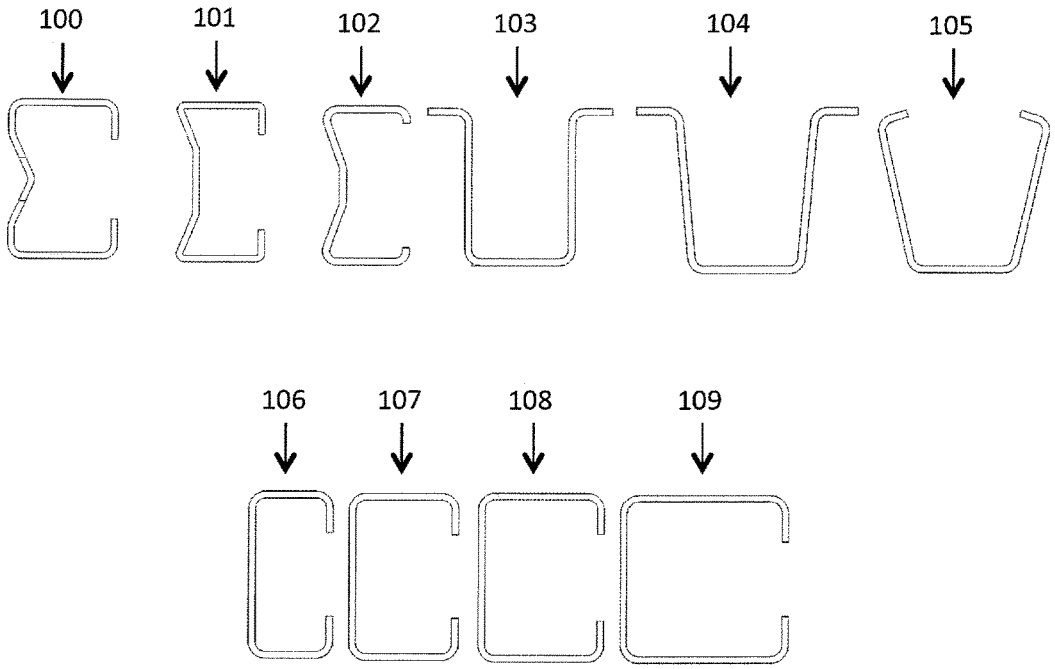
FIG. 16 illustrates various alternative post shape cross-section shapes that may be used.

FIG. 16 shows a variety of different cross-section shaped posts 1 that may also be used by altering the shape including sigma cross-sections (items 100, 101, 102), alternative U-shaped cross-sections (items 103, 104, 105) and C-sections (items 106, 107, 108 and 109).

Each design has its own positives and negatives, typically around variation in strength, the ease with which the mounting plate 4 mates with the post 1 and the degree of movement still allowed while in the slot 10 to name a few variables.

Example 4

The ability of the guardrail shown in FIGS. 1-9B to withstand a vehicle impact and redirect vehicles was tested.

The objective of the studies completed was to evaluate the performance of the above described W-beam guardrail to the requirements of Test Level 4 as detailed in the Manual for Assessing Safety Hardware (MASH) 2009. Recommended tests to evaluate performance are defined for three different test levels. Test Level 4 (TL-4) is conducted at 100 km/h and considered representative of the typical maximum allowable speed on high-speed arterial highways.

Three tests were completed as per the MASH Test Level 4 recommended matrix for longitudinal barriers length of need (LON), namely:

[1] Test 4-10 utilising an 1100 kg car impacting the test article at 100 km/h and an impact angle of 25°;

[2] Test 4-11, utilising a 2270 kg pick-up impacting the test article at 25° while traveling at 100 km/h; and

[3] Test 4-12 using a 10,000 kg single unit truck travelling at 90 km/h and impacting the barrier with an approach angle of 15°.

In all tests, the W-beam guardrail successfully contained and redirected each test vehicle. No debris or detached elements penetrated or showed potential to penetrate the occupant compartment. No fragments were distributed outside of the vehicle trajectory and therefore did not present any undue hazard to other traffic, pedestrians or work zone personnel. The vehicle in each test remained upright during and after the impact. Occupant risk factors satisfied the test criteria and the vehicle exit trajectory remained within acceptable limits.

Figure 17:
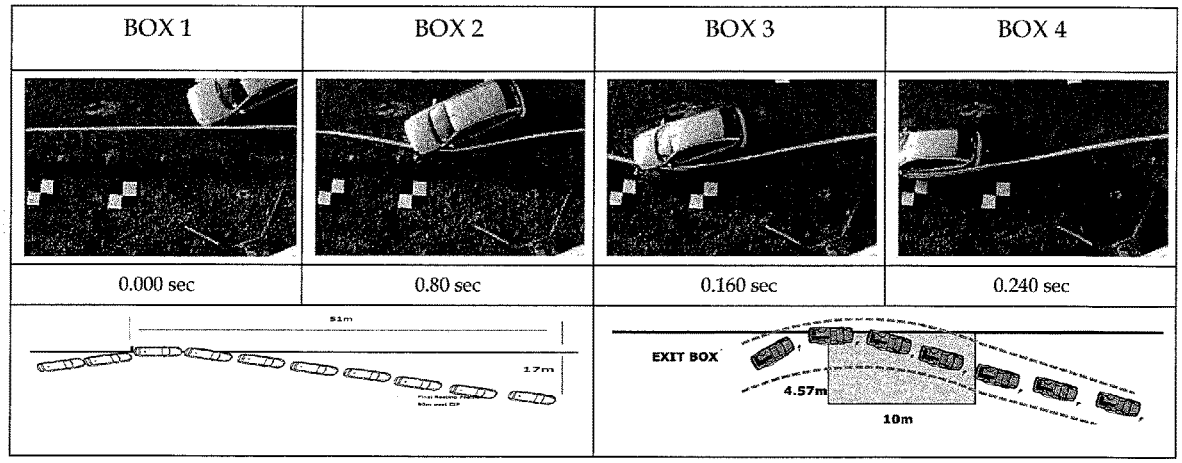
FIG. 17 shows images of the impact and vehicle path of travel in a test using a 1100 kg vehicle.
Figure 18:
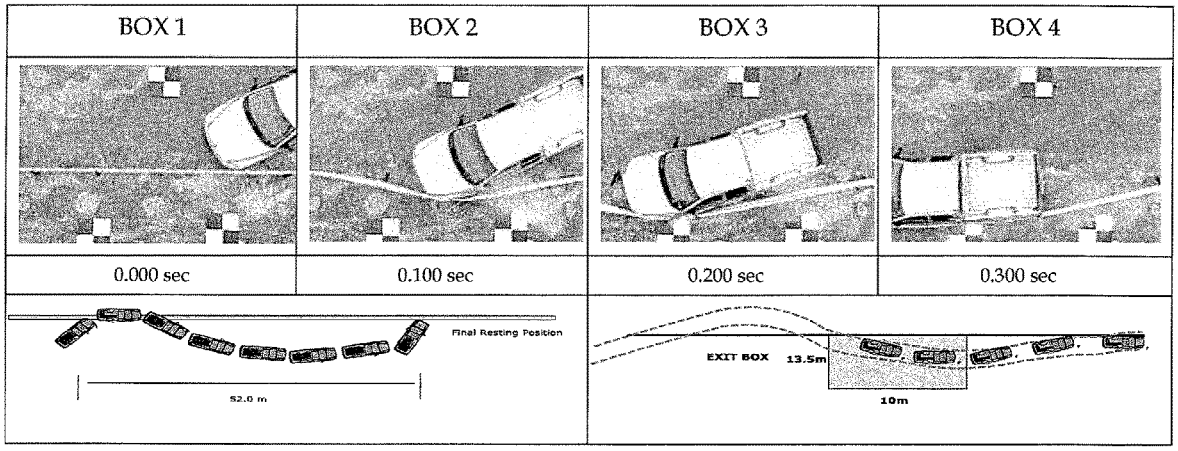
FIG. 18 shows images of the impact and vehicle path of travel in a test using a 2270 kg vehicle.
Figure 19:
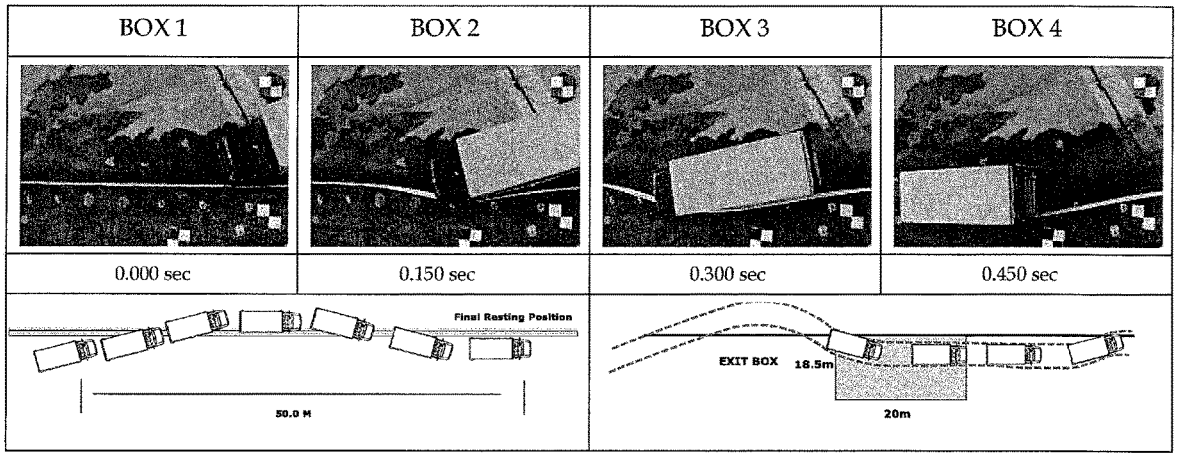
FIG. 19 shows images of the impact and vehicle path of travel in a test using a 10000 kg vehicle.

Images of the impact and vehicle path of travel for Test 4-10 are shown in FIG. 17. Images of the impact and vehicle path of travel for Test 4-11 are shown in FIG. 18. Images of the impact and vehicle path of travel for Test 4-12 are shown in FIG. 19. In each of these figures, Box 1 shows the moment of impact of the vehicle against the guardrail and Boxes 2, 3 and 4 illustrate subsequent steps as time and vehicle movement and redirection progresses. As can be seen in at least the Box 4 images in FIGS. 17 to 19, the vehicle was successfully redirected in all tests, the tests relating to a range of MASH tests.

Aspects of the guardrail have been described by way of example only and it should be appreciated that modifications and additions may be made thereto without departing from the scope of the claims herein.

What is claimed is:

1. A guardrail comprising:

a hollow post comprising at least one elongated aperture defined through a sidewall of the hollow post;

a separate mounting plate movably mounted to the post;

at least one fastener; and a longitudinal beam linked with the post via the at least one fastener and the separate mounting plate, wherein the mounting plate comprises:

a rigid body configured to engage with the at least one fastener, and at least one deformable arm about or alongside the rigid body and integrally formed with the rigid body, the at least one deformable arm being configured to extend through the at least one elongated aperture, wherein the at least one fastener passes through at least a portion of the longitudinal beam to engage with the rigid body of the mounting plate such that a link between the post and the longitudinal beam is indirect, wherein the at least one deformable arm of the mounting plate one or more of: (i) bends and (ii) breaks to release the link between the post and the longitudinal beam, when the guardrail receives an impact, and wherein the whole of the mounting plate and the at least one fastener engaged with the mounting plate are movable in tandem upwards or downwards relative to and along the post to a predetermined movement limit.

2. The guardrail as claimed in claim 1, wherein a longitudinal beam holding load is transferred from the at least one fastener to the post via the at least one deformable arm.

3. The guardrail as claimed in claim 1, wherein the rigid body of the mounting plate does not directly contact the post.

4. The guardrail as claimed in claim 1, wherein the at least one deformable arm has least one of:

(a) a smaller size relative to the body, (b) a smaller width relative to the body, (c) a material of weaker strength or elasticity than the body, (d) a shape of a weaker strength than the body, and (e) material treatments about the at least one deformable region or regions.

5. The guardrail as claimed in claim 1, wherein the mounting plate links the longitudinal beam to the post with linking forces transferred from the mounting plate to the post at post sides.

6. The guardrail as claimed in claim 1, wherein the mounting plate is pulled out of the post to release the post from the longitudinal beam when the guardrail receives the impact.

7. The guardrail as claimed in claim 1, wherein the at least one fastener is drawn out of the mounting plate to release the post from the longitudinal beam when the guardrail receives the impact.

8. The guardrail as claimed in claim 1 wherein the post twists or turns sideways and the at least one deformable arm of the mounting plate one or more of (i) bends and (ii) breaks to allow the post and the longitudinal beam to separate, when the guardrail receives the impact.

9. The guardrail as claimed in claim 1, wherein the whole of the mounting plate and the at least one fastener engaged with the mounting plate move upwards or downwards relative to the post as the post hinges backwards when the guardrail receives the impact, and when the mounting plate reaches the predetermined movement limit, the at least one deformable arm one or more of: (i) bends and (ii) breaks to release the post from the longitudinal beam.

10. The guardrail as claimed in claim 1, wherein the mounting plate has a centrally-located body and the at least one deformable arm extends on a respective side of the centrally-located body.

11. The guardrail as claimed in claim 10, wherein the at least one deformable arm or a part thereof has a face that bears on at least one surface of the post when the at least one fastener is tightened.

12. The guardrail as claimed in claim 10, wherein the at least one deformable arm extends to a higher strength portion compared to the at least one deformable arm, the higher strength portion having a wider bearing face on the post.

13. The guardrail as claimed in claim 10, wherein the at least one deformable arm helps seat the mounting plate and limit a range of movement of the mounting plate once fitted to the post.

14. The guardrail as claimed in claim 13, wherein the limited range of movement is one or more of (i) rotational and (ii) vertical plane movement of the mounting plate relative to the post.

15. The guardrail as claimed in claim 1, wherein the post is U-shaped and the at least one elongated aperture is on or about a post side or post sides, and the at least one deformable arm extends horizontally through the at least one elongated aperture.

16. The guardrail as claimed in claim 15, wherein the U-shape post includes at least one flange extending from each end of the U-shape cross-section on which the at least one deformable arm bears.

17. The guardrail as claimed in claim 15, wherein the at least one elongated aperture in the post is sized so that one or more of:

(a) the at least one elongated aperture is elongated to allow up to 45 degrees of rotational movement of the mounting plate relative to the post about a horizontal axis, (b) the at least one elongated aperture has a width that allows up to 30 degrees of rotational movement of the mounting plate relative to the post about a vertical axis, and (c) the at least one elongated aperture is elongated to allow for up to 100 mm of vertical movement in the mounting plate up or down relative to the post.

18. The guardrail as claimed in claim 1, wherein the at least one fastener is a bolt with a male thread that threads directly into a complementary female thread in the mounting plate.

19. The guardrail as claimed in claim 1, wherein the at least one fastener is a bolt with a male thread that threads onto a nut, the mounting plate acting as a washer, the shaft of the bolt passing through a hole in the mounting plate before meeting the nut.

20. An assembly comprising:

a hollow guardrail post comprising at least one elongated aperture defined through a sidewall of the hollow guardrail post;

at least one fastener; and at least one separate mounting plate movably mounted to the post, the at least one separate mounting plate comprising:

a rigid body including an aperture configured to receive the at least one fastener therethrough, the at least one fastener passing through the aperture and engaging with at least a portion of a longitudinal beam; and at least one deformable arm about or alongside the aperture in the rigid body and integrally formed with the rigid body, the at least one deformable arm being configured to engage with at least a portion of the post, the at least one deformable arm being configured to extend through the at least one elongated aperture, wherein the whole of the mounting plate and the at least one fastener engaged with the mounting plate are movable in tandem upwards or downwards relative to and along the post to a predetermined movement limit, and wherein the at least one deformable arm of the mounting plate one or more of: (i) bends and (ii) breaks to allow the post and the longitudinal beam, when the guardrail receives an impact to separate.

21. A mounting plate configured to be used in a guardrail assembly including a hollow post including at least one elongated aperture defined through a sidewall of the hollow post and a longitudinal beam linked with the post via at least one fastener, the mounting plate comprising:

a rigid body configured to engage with the at least one fastener; and at least one deformable arm about or alongside the rigid body and integrally formed with the rigid body, the at least one deformable arm being configured to extend through the at least one elongated aperture defined through the sidewall of the hollow post, the at least one deformable arm of the mounting plate one or more of: (i) bending and (ii) breaking to release a link between the post and the longitudinal beam, when the guardrail receives an impact, wherein the mounting plate is a planar component.

* * * * *